United States Patent [19]

Crawshaw et al.

[11] 4,403,204

[45] Sep. 6, 1983

[54] TORQUE MOTOR

[75] Inventors: James R. Crawshaw, Trotwood; David W. Mossbarger, Xenia, both of Ohio

[73] Assignee: TRW Inc., Cleveland, Ohio

[21] Appl. No.: 339,354

[22] Filed: Jan. 15, 1982

[51] Int. Cl.[3] ..... H01F 7/08

[52] U.S. Cl. ..... 335/229; 335/272

[58] Field of Search ..... 335/229, 230, 234, 272

[56] References Cited

U.S. PATENT DOCUMENTS

| | | | |
|---|---|---|---|
| 2,718,614 | 9/1955 | Gamble | 335/229 |
| 2,891,181 | 6/1959 | Atchley | 335/230 X |
| 2,962,611 | 11/1960 | Atchley | 310/38 X |
| 3,076,920 | 2/1963 | Gordon et al. | 335/230 |
| 3,214,646 | 10/1965 | Duff | 335/229 |
| 3,329,916 | 7/1967 | Carson | 335/230 |
| 3,938,778 | 2/1976 | Hansen et al. | 335/230 X |

*Primary Examiner*—George Harris

*Attorney, Agent, or Firm*—Biebel, French & Nauman

[57] ABSTRACT

A flat armature type of torque motor includes integral transversely extending ledges formed on the pole pieces adjacent the working air gaps, and rigid non-magnetic spacer pins extending between the ledges and retained by integral portions formed on the coil bobbins for accurately maintaining the spaced-apart relationship of the pole pieces.

4 Claims, 2 Drawing Figures

TORQUE MOTOR

BACKGROUND OF THE INVENTION

This invention relates to torque motors and more particularly to flat armature torque motors of the general kind shown in the U.S. Patents of Gamble, No. 2,718,614 issued Sept. 20, 1955; Atchley, No. 2,891,181 issued June 16, 1959; Duff, No. 3,214,646 issued Oct. 26, 1965; and Hansen et al, No. 3,938,778 issued Feb. 17, 1976.

In flat armature torque motors of the general kind described in the above-identified patents, permanent magnets are mounted on the poles and direct a substantial flux through air gaps between the poles and through the armature member which is normally spring-centered in the gap between the poles. Such torque motors further commonly employ bobbin wound coils by means of which a portion of the magnetic flux may be subtracted at one air gap and added at the opposite air gap for causing the armature to be urged in one or the other direction. The movement of the armature, under the influence of the high magnetic flux and the imbalance of the flux created by the bobbin wound coils is carried usually by direct lever connections to a remote location where a part is caused to be moved by the torque motor.

Such motors are characterized by a relatively high force output compared to a relatively low amount of control current required, and this force, or position output of the armature, may be proportional to a DC current applied to one or the other coils.

Construction of a torque motor requires that two pole members be spaced from each other a finite distance defining the armature or air gap. However, under the influence of the relatively high magnetic force, the poles tend to close this gap or become unbalanced.

Present arrangements for controlling this air gap include the use of wide support brackets at the center of the pole piece with no support at the outer extreme ends where the forces are the greatest. Also, tubular spacers with screws through the spacers have been used at the ends of the pole pieces. However, these arrangements either provide no support at the ends of the pole pieces to control the air gap or require additional parts and machining operations in order to control this air gap. Plus the tubular spacer arrangement requires large ledges on the pole pieces that tend to short circuit the magnetic flux path, or otherwise increase magnetic leakage.

SUMMARY OF THE INVENTION

The present invention is directed to an improved flat armature torque motor, including means for precisely controlling the dimensions of magnetic air gap without the necessity of using tubular spacers, screws, or other spacer means which require machining operations. In the torque motor of the present invention, the poles themselves are formed with transversely directed ledge or tab portions. These extend outwardly from the poles away from the air gap, but are positioned adjacent the ends of the poles so that pairs of the tabs or ledges are in juxtaposition to each other across the air gap. The bobbin is provided with small ledges or bosses, which may be formed as a molded or integral part of the bobbin, which receive rigid elements such as pins of a defined length. The bosses are positioned such that the pins carried in the bosses are received between the pole portions or ledges. The pins thus define spacer means which extend between the ledge portions which are positioned adjacent the armature, and thus maintain the air gap at the ends of the poles at a precise fixed dimension. The bobbin bosses also provide an anchoring support for the coil bobbins. Preferably the spacer means or pins are of low permeability or essentially non-magnetic to provide a minimum of flux leakage.

It is accordingly an important object of this invention to provide a torque motor, as outlined above, employing rigid spacer means of low permeability or low flux leakage extending between integral pole extensions to define the air gap.

A further object of the invention is the provision of a bobbin having integral portions which extend between pole extensions, and non-magnetic pins of precisely controlled lengths extending through said bobbin portions and engaging said pole extensions for defining the air gap.

These and other objects and advantages of the present invention will be apparent from the following description, the accompanying drawings and the appended claims.

DESCRIPTION OF PREFERRED EMBODIMENT

Figures 1, 2, 3, 4:
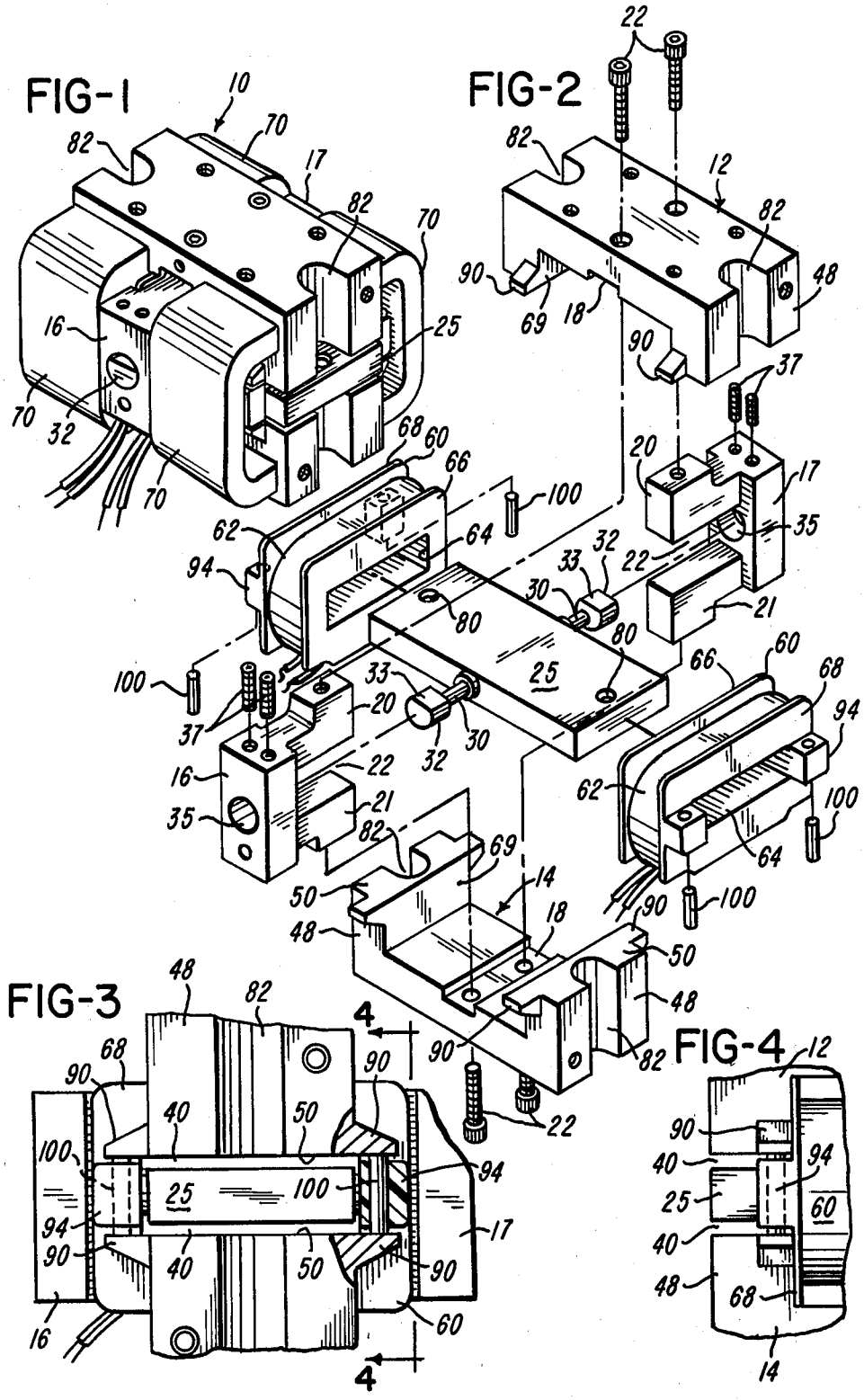
FIG. 1 is a perspective view of a torque motor according to this invention.
FIG. 2 is an exploded view, in perspective, of the motor of FIG. 1 with the permanent magnets removed.
FIG. 3 is an enlarged fragmentary end view thereof with the magnets not shown.
FIG. 4 is a fragmentary side view looking generally along the line 4—4 of FIG. 3.

Referring to the figures of the drawing, and particularly to FIGS. 1 and 2, a flat armature torque motor emboding the present invention is illustrated generally at 10. The flat armature torque motor 10 includes a pair of generally U-shaped pole pieces 12 and 14 formed of high flux conductivity ferrous material, having low residual magnetism. The pole pieces 12 and 14 are centrally supported and held in spaced apart relation by a pair of identical generally C-shaped brackets 16 and 17. As shown in FIG. 1, each of the pole pieces 12 and 14 is provided with an inwardly opening transverse central slot 18, and the brackets 16 and 17 are formed with inwardly extending, vertically spaced arms 20 and 21 defining therebetween an armature receiving opening or space 22. The upper and lower ends of the arms 20 and 21 are respectively received within the slots 18 of the pole pieces 12 and 14, and thus serve to hold the pole pieces 12 and 14 in spaced apart relation. The pole pieces 12 and 14 are retained on the brackets 16 and 17 by threaded fasteners 22 which extend through the pole pieces and into the adjacent bracket arm 20 or 21.

The brackets 16 and 17 also provide means for torsionally mounting a flat armature illustrated generally at 25 in FIGS. 1 and 2. The armature 25 is also formed of high flux conductivity material having a low residual magnetism. The armature 25 is preferably torsionally mounted at its center with respect to the brackets 16 and 17 by means of a central torsional support rod 30 which terminates in enlarged semi-cylindrical armature supports 32. The supports 32 are formed with a flat or planar adjusting surface 33. The enlarged supports 32 are proportioned to be received within a cylindrical opening 35 formed in each of the brackets 16 and 17, with the flat 33 exposed to a pair of adjusting screws 37 extending through the bracket and into the opening 35 for contact with the flat 33, by means of which the precise neutral position of the armature 25 may be adjusted.

When the armature is in position on the brackets, its opposite ends are centrally located in working air gaps 40 as best seen in FIG. 3, between the upper and lower pole pieces. Since the torque motor is symmetrical, each of the opposite ends of the armature 25 is centrally located within an air gap 40 between each of the unwardly extending arms or ends 48 of the respective pole pieces 12 and 14. The inwardly extending arms terminate in a planar pole surface 50, as best seen in FIG. 2 with respect to the lower pole piece 14, and these opposed surfaces 50 define the working air gap 40 at the ends of the armature.

A pair of essentially identical bobbins 60 provide support for electric coils 62, as best seen in FIG. 2. Each of the bobbins 60 has a central opening 64 therethrough to be received over the armature 25. The inner transversely planar walls 66 of the bobbins 60 are received in abutment with the flat planar side walls or surfaces of the bracket arms 20 and 21 prior to the assembly of the respective upper and lower pole pieces 12 and 14. Similarly, each of the bobbins is provided with a forward or outer planar surfaces 68 which forms a close fit with the inside planar surface 69 of the arms 48 of the respective pole pieces, by means of which the bobbins are retained and aligned within the torque motor.

Completing the overall torque motor structure, two pairs of horseshoe-shaped permanent magnets 70 are removably received in straddling relation to the bobbins, as best shown in FIG. 1 with their ends against the side walls of the pole pieces 12 and 14. All of the like poles of the four magnets 70 are received against the outside planar surface of one of the pole pieces 12 while the opposite like poles of all the magnets are received against the opposite or opposed pole piece 14, in conventional torque motor construction, so that there is created across each of the transversely opposite air gaps 40, at each end of the poles, like fields of magnetic flux. Thus, when the armature 25 is in a central or null position, as shown in FIG. 3, the forces on the armature 25 are essentially balanced.

The electric coils 62 wound on the coil forms or bobbins 60 may be independently energized or may be connected in series for simultaneous energization, for disturbing or creating an imbalance in the magnetic flux created by the magnets 70 in such a manner as to subtract the flux at one of the air gaps 40 and to add to the flux at the other of the air gaps, causing a rotational movement of the armature 25 about the torsional connecting spring or rod 30. This rotational movement may be delivered to a remote location or part being controlled, by means of a rod or the like, not shown, received in one or the other of tapped openings 80 formed in the ends of the armature 25. It will be seen that the arms 48 of the pole pieces are provided with a vertically extending groove or slot 82 exposing the tapped openings 80.

The movement of the armature 25, in response to the application of electric current to the coils, may be proportional to this current, over a limited range. In other applications the movement of the armature may be to limit positions as defined by the air gaps 40, where proportionallity is not desired or required.

As noted above, the high constant forces across the air gaps 40 between the respective pole pieces creates difficulty in maintaining the precise alignment of the pole pieces with respect to each other and to the intervening armature 25. It is important that the air gaps be accurately maintained to a predetermined value over a long period of use, even where the torque motor is subject to vibration or abuse. For this purpose, the present invention includes means on each of the poles, at the arms 48, defining small integral transversely extending ledges 90, as best seen in FIGS. 2, 3 and 4. The ledges 90 extend transversely or outwardly with respect to the air gap and the intervening armature 25 and define lower planar surfaces which are, in effect, extensions of the planar surfaces 50 which define the air gaps 40. Thus, the ledges 90 of the respective pole pieces 12 and 14 are in juxtaposition with each other.

The bobbins 60 are provided with a pair of rectangular integral portions 94 formed as part of the wall 68, which extend into the spaces between the pairs of ledges 90, as perhaps best shown in FIGS. 3 and 4. The bobbin portions 94 are formed with a thickness which is essentially the same as or somewhat less than the space between the ledges 90, and thus almost the same as, or slightly less than, the air gaps 40. Each of the extensions 94 carries an essentially cylindrical metal or rigid pin 100 of precisely defined length having the ends extending therethrough and into direct contact with the flat opposed surfaces defined by the ledges 90, as shown in FIG. 3. The pins 100 may are preferably formed of any suitable rigid low permeability or essentially non-magnetic material, such as 302 stainless, and are accurately formed to a given length defining the air gap 40.

In precision applications it is expected that the length of the pins 100 will be maintained to the nearest one thousandth of an inch. Thus, the pins 100, which extend slightly beyond the bobbin portions 94 have ends in abutment with the ledges 90 for maintaining the air gaps at a precise fixed dimension upon the application of high magnetic flux to the poles across the air gap, where the forces are the highest and where the effective moment arms are the greatest with respect to the individual pole pieces. Since the ledges 90 extend transversely they are in non-interferring relation to the free movement of the ends of the armature 25 within the air gap and yet are positioned substantially at the ends of the pole pieces where the accurate length of the pins 100 is most effective in defining and maintaining the air gap. Further, the integral portions 94 of the bobbins 60 have the secondary function of providing additional support for the bobbins with respect to the pole pieces, providing for accurate location of the position of the bobbins.

While essentially non-magnetic pins are preferred, many of the advantages of the invention could be achieved by the use of small pins of high permeability which rapidly flux saturate, where the resulting small flux leakage may be tolerated.

While the form of apparatus herein described constitutes a preferred embodiment of this invention, it is to be understood that the invention is not limited to this precise form of apparatus, and that changes may be made therein without departing from the scope of the invention.

What is claimed is:

1. In a torque motor having spaced poles defining an armature gap therebetween and an armature normally centered in the space between the poles, the improvement comprising:

means on each of said poles defining spaced ledge portions extending outwardly of the poles away from said gap and small rigid spacer means of precise length extending between said ledge portions adjacent said armature for maintaining said gap at a fixed dimension upon the application of a magnetic flux to said poles.

2. The torque motor of claim 1 in which said spacer means comprise non-magnetic pins.

3. In a torque motor having pairs of spaced pole pieces defining armature air gaps and an armature extending between said pole pairs with the ends thereof in said gaps, the improvement comprising:

means on each of said pole pieces defining integral transversely extending ledges, with the ledges of opposite pole pieces being in juxtaposition adjacent said gaps, coil bobbins having portions received between said ledges, and pins carried in each said bobbin portions having the ends thereof in abutment with said ledges for maintaining said gaps at a fixed minimum dimension upon the application of high magnetic flux to said pole pieces across said gaps.

4. The torque motor of claim 3 in which said bobbin portions are formed as integral rectangular extensions of said bobbin.

* * * * *